US008944547B2

(12) United States Patent
Fukunaga

(10) Patent No.: US 8,944,547 B2
(45) Date of Patent: Feb. 3, 2015

(54) RECORDING APPARATUS

(75) Inventor: Etsushi Fukunaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 423 days.

(21) Appl. No.: 12/986,688

(22) Filed: Jan. 7, 2011

(65) Prior Publication Data

US 2011/0181659 A1 Jul. 28, 2011

(30) Foreign Application Priority Data

Jan. 26, 2010 (JP) ..... 2010-014176

(51) Int. Cl.
*B41J 2/165* (2006.01)
*B41J 25/304* (2006.01)
*B41J 19/00* (2006.01)

(52) U.S. Cl.
CPC ..... *B41J 25/304* (2013.01); *B41J 19/00* (2013.01)
USPC ..... 347/8

(58) Field of Classification Search
None
See application file for complete search history.

(56) References Cited

U.S. PATENT DOCUMENTS 5,887,987 A * 3/1999 Sawano ..... 400/56
6,629,788 B2 * 10/2003 Miranda et al. ..... 400/59

FOREIGN PATENT DOCUMENTS

JP 2001-171194 A 6/2001

* cited by examiner

*Primary Examiner* — Alejandro Valencia
(74) *Attorney, Agent, or Firm* — Fitzpatrick, Cella, Harper & Scinto

(57) ABSTRACT

A recording apparatus has a carriage, a carriage rail, a guide rail, an adjusting member and a support base. A first adjusting mechanism displaces the guide rail in a direction crossing the main-scanning direction relatively to the adjusting member and adjusts the position of the guide rail. A second adjusting mechanism displaces the adjusting member in a direction crossing the main-scanning direction relatively to the support base and adjusts the positions of the guide rail and the adjusting member. The first adjusting mechanism has a plurality of guide rail adjusted portions for displacing the guide rail with respect to the adjusting member and the second adjusting mechanism has a plurality of adjusting member adjusted portions for displacing the adjusting member with respect to the support base.

7 Claims, 9 Drawing Sheets

RECORDING APPARATUS

BACKGROUND OF THE INVENTION

1. Field of the Invention

The present invention relates to a recording apparatus and specifically to an ink jet recording apparatus that performs recording using liquid ink.

2. Description of the Related Art

The ink jet recording apparatus discharges fine ink droplets from a plurality of nozzles that is provided in a recording head and forms an image onto the recording medium. There is a type of recording head, wherein the recording head is mounted on a carriage that is provided movably in the width direction of the recording medium and performs recording while moving in the width direction (main-scanning direction) of the recording medium.

A carriage rail that guides the carriage in the main-scanning direction to slidably move along the carriage rail supports the carriage that mounts the recording head. Also, the carriage can rotate about the carriage rail as a rotation center so as to adjust a position (degree of parallelization) with respect to the recording medium. Rollers are disposed on the carriage, and a guide rail that is extended parallel to the carriage rail is pinched by a plurality of rollers or the guide rail pinches the rollers so that the guide rail supports the carriage. Also, at the same time, the guide rail limits the posture of the carriage in the rotation direction with respect to the recording medium.

The posture of the carriage in the rotation direction with respect to the recording medium is determined by the position in the orthogonal direction (here, described as the vertical direction for example, in other words, the height direction) to the main-scanning direction of the carriage of the guide rail. Thus, if the position of the height direction of the guide rail is not constant in the main-scanning direction of the carriage, the recording is not performed in high quality. Japanese Patent Application Laid-Open No. 2001-171194 discloses a method to make the posture of the carriage in the main-scanning direction to be constant. According to the patent, the position of the guide rail in the height direction can be adjusted in each of a plurality of portions so as to suppress the changes in the orientation of the carriage by the position in the main-scanning direction. In other words, a mechanism that can adjust the position of the guide rail in the height direction with respect to a supporting member that supports the guide rail is provided in constant interval in the main-scanning direction. Thus, the position of the guide rail in the height direction can be easily finely adjusted.

However, problems are present even using the configuration of Japanese Patent Application Laid-Open No. 2001-171194 in a case where higher image quality is pursued. Specifically, when an adjusting or adjusted portion of one adjacent guide rail is adjusted, an adjusted portion of the other adjacent guide rail that was already adjusted is moved due to a stiffness of the guide rail or the like. In this case, re-adjustment may be performed to enhance the position precision of the adjusted portions of the guide rail and the intermediate position therebetween. To perform the re-adjustment, the number of adjustment processes and an adjustment time for adjusting the position of the guide rail in the height direction are increased and the guide rail that is adjusted with high precision may be difficult to mass produce. Further to the problem, a high image quality ink jet recording apparatus may also be difficult to mass produce.

SUMMARY OF THE INVENTION

Thus, an object of the invention is to provide a higher image quality ink jet recording apparatus in which the position precision of the intermediate position between the adjusted portions of the guide rail is enhanced, the adjustment time is decreased and mass production is accomplished.

The recording apparatus according to the invention has a recording head, a carriage that reciprocates in a main-scanning direction, and a carriage rail that extends in the main-scanning direction, slidably supports the carriage in the main-scanning direction and rotatably supports the carriage in orthogonal directions that cross at right angles to the main-scanning direction. Also, the recording head has a guide rail that supports the carriage and controls the posture in the rotation direction with respect to the carriage rail of the carriage that extends in the main-scanning direction, an adjusting member to which the guide rail is fastened and a support base to which the adjusting member is fastened.

The recording head according to the invention further includes a first adjusting mechanism that displaces the guide rail in a direction crossing to the main-scanning direction relatively with respect to the adjusting member and adjusts the position of the guide rail, and a second adjusting mechanism that displaces the adjusting member in a direction crossing to the main-scanning direction relatively with respect to the support base and adjusts the positions of the guide rail and the adjusting member.

The first adjusting mechanism has a plurality of guide rail adjusted portions that displaces the guide rail with respect to the adjusting member and the second adjusting mechanism has a plurality of adjusting member adjusted portions that displaces the adjusting member with respect to the support base.

According to the invention, the position precision of the guide rail is increased and the adjustment time of the guide rail can be shortened.

Further features of the present invention will become apparent from the following description of exemplary embodiments with reference to the attached drawings.

DESCRIPTION OF THE EMBODIMENTS

Figure 1:
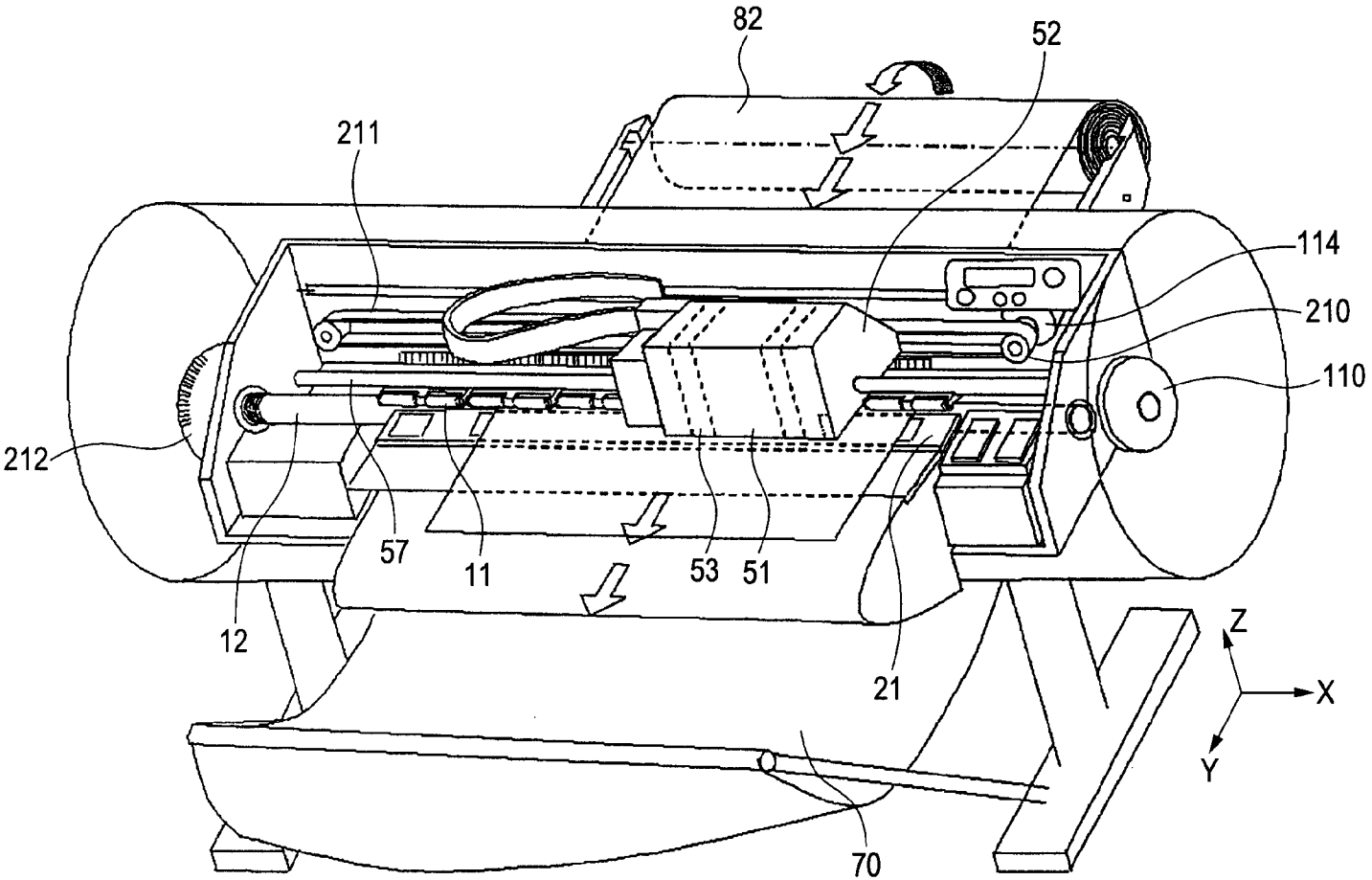
FIG. 1 is a perspective view schematically illustrating an embodiment of a recording apparatus according to the invention.

Preferred embodiments of the present invention will now be described in detail in accordance with the accompanying drawings.

Hereinafter, embodiments of the invention will be described with reference to the drawings. Also, configurations having similar functions in the drawings are assigned similar reference numerals, and thus the description thereof will be omitted.

FIG. 1 is a perspective view schematically illustrating an embodiment of a recording apparatus according to the invention. The transportation direction of the recording medium is the Y direction, the vertical direction (movement direction of a carriage 52) to the transportation direction of the recording medium is the X direction and the vertical direction to a recording surface of the recording medium is Z the direction. Also, in following description, a roll paper 82 is used as the recording medium, however the invention is not limited to the configuration and a cut paper may be also used.

An ink jet recording apparatus of the invention is configured such that the roll paper 82 that is the recording medium is transported by a transporting roller 12, an ink liquid droplet is discharged from a recording head 51 with respect to the roll paper 82 that is transported and the recording medium is discharged to an accommodating section after an image is formed.

The roll paper 82 that is the recording medium and wound in a roll shape is arranged in uppermost upstream of a transportation path of the recording medium, a front tip section of the roll paper 82 is held by a roller pair 13 consisting of a transporting roller 12 and pinch rollers 11 and is transported to the recording section in which the recording is performed.

Specifically, a recording medium transportation motor 110 is provided so as to transport the roll paper 82 that is a recording medium in a sub-scanning direction (Y direction). The recording medium transportation motor 110 drives and rotates the transporting roller 12 that consist of the roller pair 13 with the pinch roller 11 that is driven roller by a timing belt (not shown) and transports the roll paper 82 to the sub-scanning direction. The transporting roller 12 is driven and rotated by the recording medium transportation motor 110 so that the roll paper 82 that is held by the roller pair 13 is transported to a downstream of the transportation path of the recording medium. An encoder film 212 is provided integrally with the transporting roller 12. A plurality of slits that is formed successively along the entire periphery of the encoder film 212 is read and counted by an encoder sensor (not shown) so that the rotation amount of the transporting roller 12, in other words, transportation amount of the roll paper 82 is detected. Thus, the recording medium transportation motor 110 is feedback controlled based on the transportation amount of the detected roll paper 82.

A recording section is provided in the downstream of the roll paper 82. A carriage 52 that is reciprocated in a main-scanning direction (X direction) is provided in the recording section. The carriage 52 includes a head holder 53 and the recording head 51 is detachably mounted at the head holder 53. Ink is supplied to the recording head 51 through an ink supply tube (not shown) from an ink container unit (not shown). Also, the ink jet recording apparatus includes a carriage motor 114. The carriage motor 114 is a motor to reciprocate the recording head 51 in main-scanning direction and the carriage 52 that mounts the recording head 51 moves along the main-scanning direction. A pulley 210 is provided in a rotation shaft of the carriage motor 114, a timing belt 211 is hung at the pulley 210 in a tensed state and the carriage 52 is contacted to the timing belt 211. Accordingly, the carriage motor 114 rotates in the normal and reverse directions and the carriage 52 is guided to a carriage rail 57 so that upside of a platen 21 moves parallel with a planar surface of the platen 21. Also, with respect to one color, a plurality of nozzles is provided in the recording head and ink is discharged from the nozzles.

As described above, the object of the image forming is obtained such that the discharge of ink from the recording head mounted on the carriage 52 that reciprocates in the main-scanning direction and an operation of the transporting roller 12 that takes out the roll paper 82 by a predetermined amount and transports the roll paper 82 in sub-scanning direction are performed alternatively to each other.

The roll paper 82 in which the image is formed is transported further to the downstream and is cut by a cutter (not shown) so that the recording material that is separated from the roll paper 82 is accommodated in an accommodating section 22.

Next, a configuration of two rails that support the carriage 52 will be described using FIG. 2.

Figure 2:
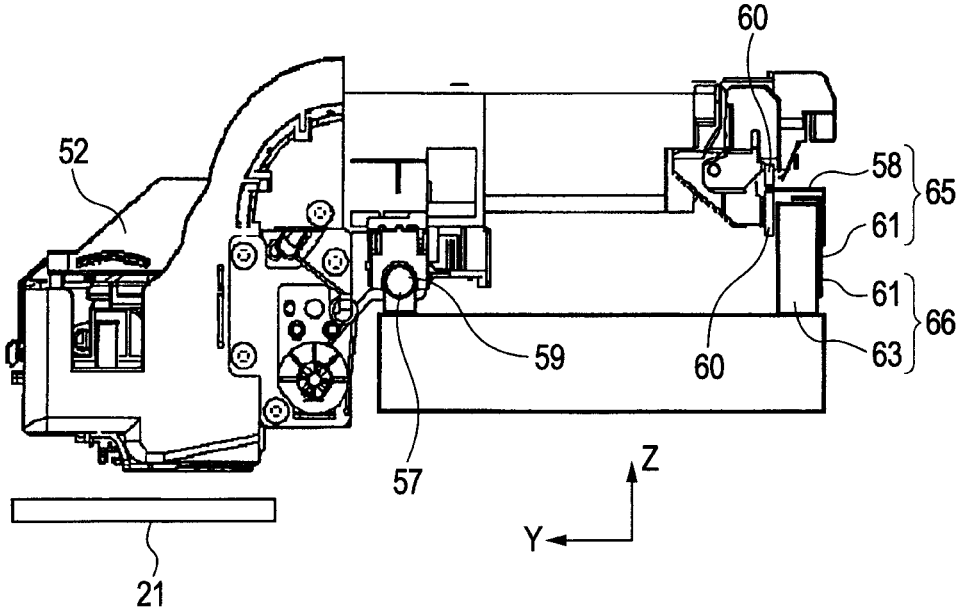
FIG. 2 is a side elevation view schematically illustrating an example of a rail configuration that supports a carriage.

FIG. 2 is a cross-sectional view schematically illustrating of an example of two rail configuration that support the carriage. The main-scanning direction (X direction) is from the near side to the far side in the drawing, even though the direction is not shown in FIG. 2.

The carriage 52 includes a bearing 59 that is engaged to the carriage rail 57, and rollers 60 that are rotatably engaged to the guide rail 58. Thus, the carriage 52 is supported by the carriage rail 57 that is extended in the main-scanning direction and is rotatable in an orthogonal direction that crosses at right angles to the scanning direction. Also, configuration is such that a posture in the rotation direction is determined at the guide rail 58 that is extended in the main-scanning direction. Specifically, the carriage 52 is slidable along the carriage rail 57 through the bearing 59 and a pair of the rollers 60 sandwiches the guide rail 58 so that the posture (position) in the rotation direction of the carriage 52 is controlled. Also, the carriage 52 rotates the rollers 60 and can reciprocate in the main-scanning direction along both rails 57 and 58. The guide rail 58 is attached to the adjusting member 61 and a first adjusting mechanism is configured by the guide rail 58 and an adjusting member 61. Also, the adjusting member 61 is attached a support base 63 that is a supporting member and a second adjusting mechanism is configured by the adjusting member 61 and the supporting member 63.

Next, using FIG. 3, a guide rail adjusting mechanism that is configured by the first and second adjusting mechanism and adjusts the position of a direction (hereinafter referred to as the vertical direction, in other words, height direction as an example) of the guide rail 58 that crosses to the main-scanning direction of the carriage 52 will be described. Also, similar configurations to the above-described description will not be included.

Figure 3:
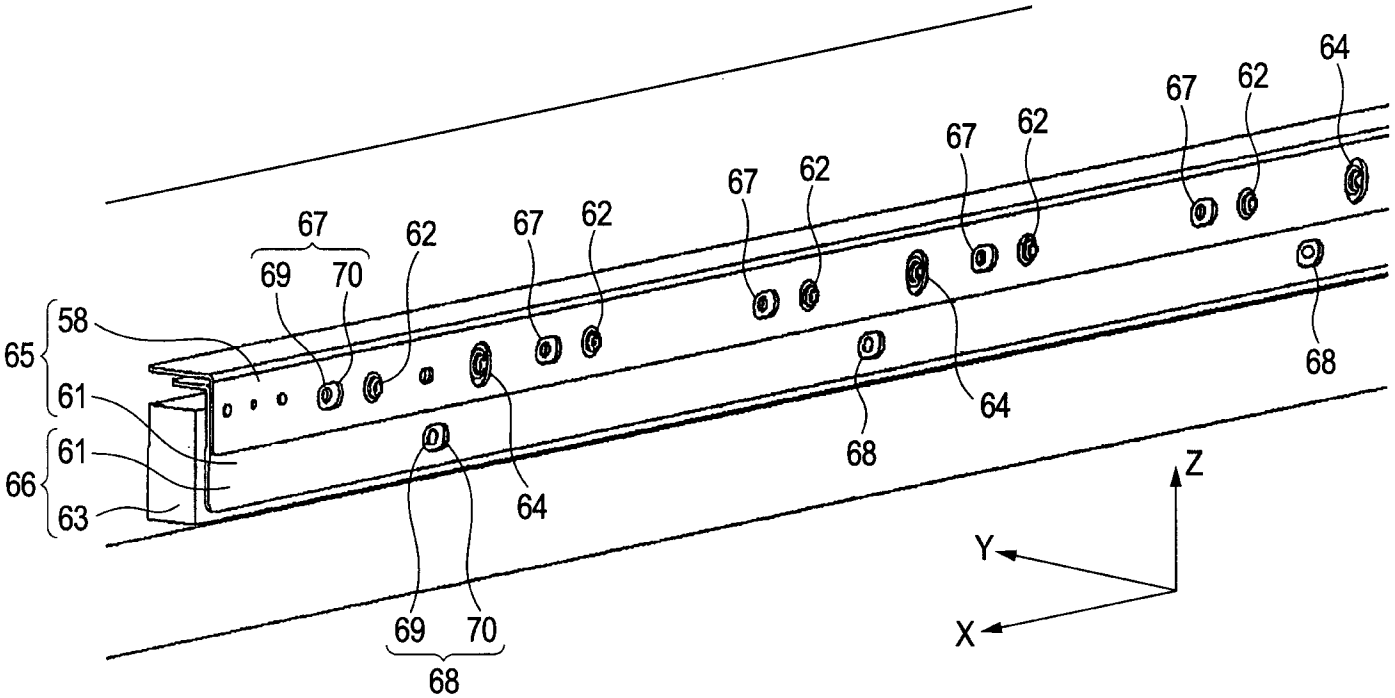
FIG. 3 is a perspective view schematically illustrating an example of a configuration of a guide rail adjusting mechanism.

FIG. 3 is a perspective view schematically illustrating an example of a configuration of a guide rail adjusting mechanism. The guide rail 58 is fastened to the adjusting member 61 in fastening portions with guide rail fastening screws 62 that are first fixing units. The adjusting member 61 is fastened in fastening portions to the support base 63 with the adjusting member fastening screws 64 that are second fixing units. The guide rail 58 determines posture in the rotation direction of the carriage 52. Thus, a position adjustment in high precision with respect to a target position in the Z direction in FIG. 3, in other words, highly precise adjustment of the position in the height direction (vertical direction) of the guide rail 58, is necessary to minimize the movement of the posture of the carriage 52 across all areas in the main-scanning direction.

It is assumed that the position of the guide rail 58 in height direction is deviated by the position of the main-scanning direction and the variation of the rotation posture of the carriage 52 occurs. In this case, the landing position between nozzles of different colors in the recording head 51 which are arranged in positions spaced at a maximum of 100 mm in the X direction is deviated in the Y direction (hereinafter referred to as "Y direction color deviation"), and as a result, the quality of the image becomes degraded. Thus, in a printer that requires higher image quality, high precision on the order of microns is required across all regions in the Z direction shown in FIG. 3 for the guide rail 58 that decides the posture of the carriage 52 in the rotation direction. In the ink jet recording apparatus that forms an image on a large size paper, such as 40 to 60 inches (1.016 to 1.524 m) in the X direction, the length of the guide rail 58 is about 2 m. In a case where high precision of the guide rail 58 on the order of microns is realized by enhancing the precision of each part, the manufacturing cost will be greatly increased, because the precision of the parts is enhanced or larger and more precise parts are manufactured, even though the number of parts is increased. As a measurement for preventing the high costs, a configuration is considered in which the guide rail 58 can be adjusted in position in the Z direction shown in FIG. 3 for the whole area in the main-scanning direction.

Accordingly, guide rail adjusted portions 67 are provided in the X direction at an approximate maximum pitch of 100 mm between different color nozzles. In a case where the higher quality image is pursued, the position precision is enhanced not only in the guide rail adjusted portions but also in an intermediate position between the adjusted portions. However, if the stiffness of the guide rail 58 that is to be adjusted is high, the adjusted portions in which adjustment is already finished are moved due to influence of adjustment of the adjacent adjusted portions so that re-adjustment is required. Method is considered whereby the stiffness of the guide rail 58 is lowered, the guide rail 58 is deformed only in the vicinity of the adjusted portions and the influence on the adjacent adjusted portions is minimized so as to minimize the influence of the adjacent adjusted portions and to decrease the number of adjusting process. However, in this case, since only the vicinity of the adjusted portions is moved, the position precision of the middle portions of the adjusted portions to each other is worsened and a desired planarity can not be obtained.

In the past, as described above, there are problems that the position precision of the middle portions between the adjusted portions of the guide rail 58 is enhanced, the number of processes is shortened and the adjusting time cannot be decreased. Meanwhile, in the recording apparatus of the invention, a first adjusting mechanism 65 and a second adjusting mechanism 66 are provided, and a two-step adjustment that consists of a rough adjustment and a fine adjustment can be practiced.

Specifically, the second adjusting mechanism 66 has a configuration such that the rough adjustment that displaces the adjusting member 61 in a direction (X direction) crossing to the main-scanning direction relatively with respect to the support base 63 is performed. Also, the first adjusting mechanism 65 has a configuration such that the fine adjustment that displaces the guide rail 58 in a direction (X direction) crossing to the main-scanning direction relatively with respect to the adjusting member 61 is performed. The relative movement between two parts provides a round hole 69 at a side of a member that becomes a base when adjusting and an elongated round hole 70 at a relatively moving side. In other words, in the first adjusting mechanism 65, the round hole 69 is provided at the adjusting member 61 side and the elongate round hole 70 is provided at the guide rail 58 side. In the second adjusting mechanism 66, the round hole 69 is provided at the support base 63 side and the elongated round hole 70 is provided at the adjusting member 61 side. The shape of the front tip is elliptical and if the tool having a pierced shaped shaft is used to the front tip, the shaft is inserted into the round hole 69 and the front tip is inserted into the elongated round hole 70. When the shaft of the tool is rotated, the front tip can press the elongated round hole 70. Thus, the positions of only member (one of the guide rail 58 and the adjusting member 61) on which the elongate round hole 70 is provided can be adjusted.

The guide rail adjusted portions 67 that displace the guide rail 58 with respect to the adjusting member 61 are arranged in plurality at an interval in the X direction shorter than that of adjusting member adjusted portions 68 that displace the adjusting member 61 with respect to the support base 63. For example, the adjusting member adjusted portions 68 are arranged with a 200 mm pitch and the guide rail adjusted portions 67 are arranged with a 100 mm pitch. The adjusting member adjusted portions 68 are arranged at every other guide rail adjusted portions 67 between the guide rail adjusted portions 67. Further, the number of guide rail fastening screws 62 is greater than that of the fastening screws 64 so that the fastening force between the guide rail 58 and the adjusting member 61 is larger than that between the adjusting member 61 and the support base 63. In the drawings, the guide rail fastening screws 62 are arranged in numbers twice that of the adjusting member fastening screws 64.

Accordingly, in the second adjusting mechanism 66, the fastening force between the supporting member 63 and the adjusting member 61 is not strong, and the number of the adjusting member fastening screws 64 is also small. Thus, in the adjustment by the second adjusting mechanism, the adjusting member is moved over a wider range without locally moving in narrow range in which the first adjusted portions 68 are the center so that the rough adjustment can be performed without locally moving of the guide rail 58. Also, in the first adjusting mechanism 65, the fastening force between the adjusting member 61 and the guide rail 58 is strong, and the guide rail fastening screws 62 are large in number. Thus, in the adjustment by the first adjusting mechanism, the guide rail 58 is only moved locally in the narrow range in which the guide rail adjusted portions are the center. Thus, the position of the guide rail 58 can be adjusted finely.

As described above, fine adjustment of the planarity can be performed in which the adjustment that is by the influence of the movement of the adjacent adjusted portions is suppressed.

The distance between the guide rail fastening screws 62 and the guide rail adjusted portions 67 is arranged so as to be as short as possible. Similarly, the distance between the adjusting member fastening screws 64 and the adjusting member adjusted portions 68 is arranged so as to be as short as possible. The position for adjusting and the position for controlling the position of the guide rail 58 become near each other and the position precision can be enhanced. Also, when the position is adjusted, the stiffness of the member that is the base when the adjustment is made with respect to the member that is the relatively moving side becomes high so that workability of the adjustment can be increased. Specifically, the stiffness of the support base 63 in the Z direction>the stiffness of the adjusting member 61 in the Z direction>the stiffness of the guide rail 58 in the Z direction.

In a case where sheet metal that is formed in a press machining as the guide rail 58 is used for decreasing the cost, the guide rail 58 is influenced by a minor step of a joint portion of a mold of the press machine so that the position of the guide rail 58 corresponding to the step of the mold of the press machine is locally deformed. The position in the X direction of the guide rail adjusted portions 67 and the deformed portion of the guide rail 58 match. Accordingly, the portion with the worst precision may be adjusted with pinpoint accuracy.

Further to the above-described configuration, the position precision and shortening of the adjusting time of the intermediate position of the adjusted portion of the guide rail 58 can be compatible to each other by using the adjusting method as described below. The adjusting method of the guide rail 58 is described in below.

In the adjusting process, first, the second adjusting mechanism 66 is used, the adjusting member 61 on which the guide rail 58 is attached is adjusted with respect to the support base 63 and the rough adjustment is performed so as to position the guide rail 58 to a target straight line in the Z direction. Specifically, the supporting member 63 has high stiffness and the adjusting member 61 has stiffness to an extent that local deformation is not generated by the adjustment. Thus, rough adjustment of the guide rail 58 may be easily performed with respect to the target straight line in the Z direction, without local deformation in the vicinity of the adjusting member adjusted portions 68 only. Next, only the guide rail 58 is adjusted with respect to the adjusting member 61 and the planarity is adjusted on the order of microns using the first adjusting mechanism 65. Specifically, the guide rail 58 has a low stiffness so as to move only the vicinity of the guide rail adjusted portions 67; only the vicinity of the guide rail adjusted portions 67 is moved and fine adjustment of the guide rail 58 may be easily performed with respect to the target straight line in the Z direction. The guide rail 58 may be near to the target absolute value by the adjusting member adjusted portions 68 using the second adjusting mechanism 66 when the guide rail 58 is assembled to the main body, even though the position is largely different from the target value. Then, the fine adjustment of the planarity may be performed in which the influence on the adjacent adjusted portions is suppressed by the guide rail adjusted portions 67 using the first adjusting mechanism 65. As a result, re-adjustment of the position is decreased so that fine position adjustment of all areas of the guide rail 58, including not only the adjusted portions but also even the middle portion between the adjusted portions, relative to each other may be performed.

Each of the adjustment mechanisms is described below in detail.

Figure 5:
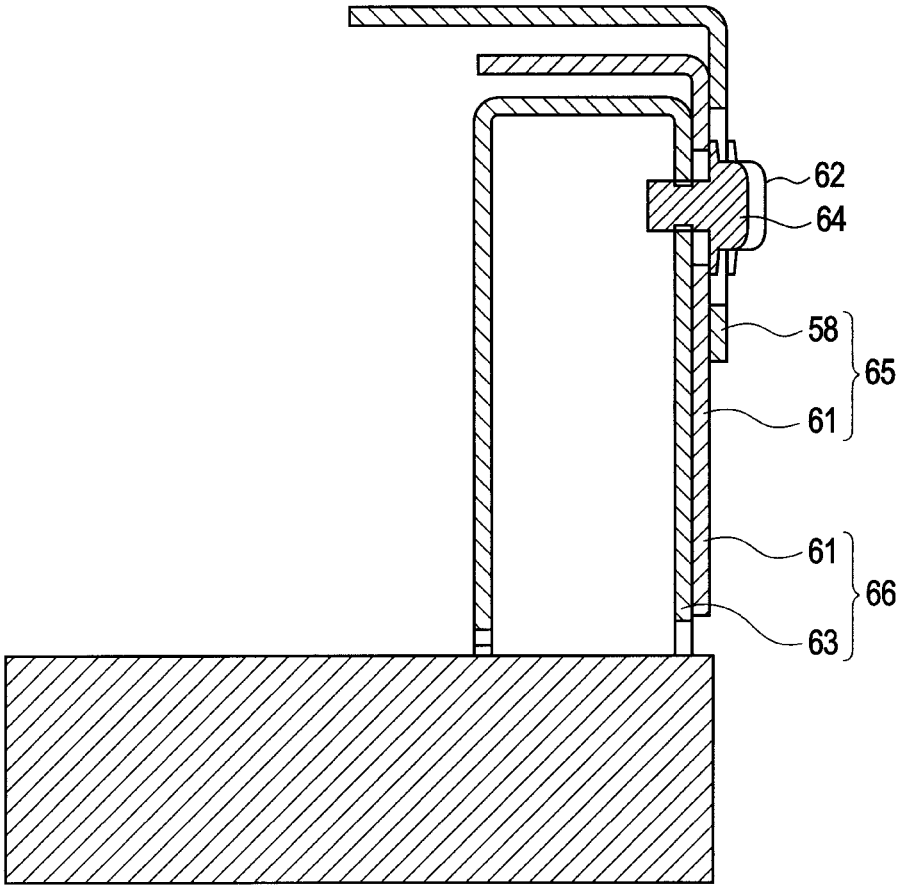
FIG. 5 is a cross-sectional view of the adjusting mechanism of the guide rail.
Figure 8:
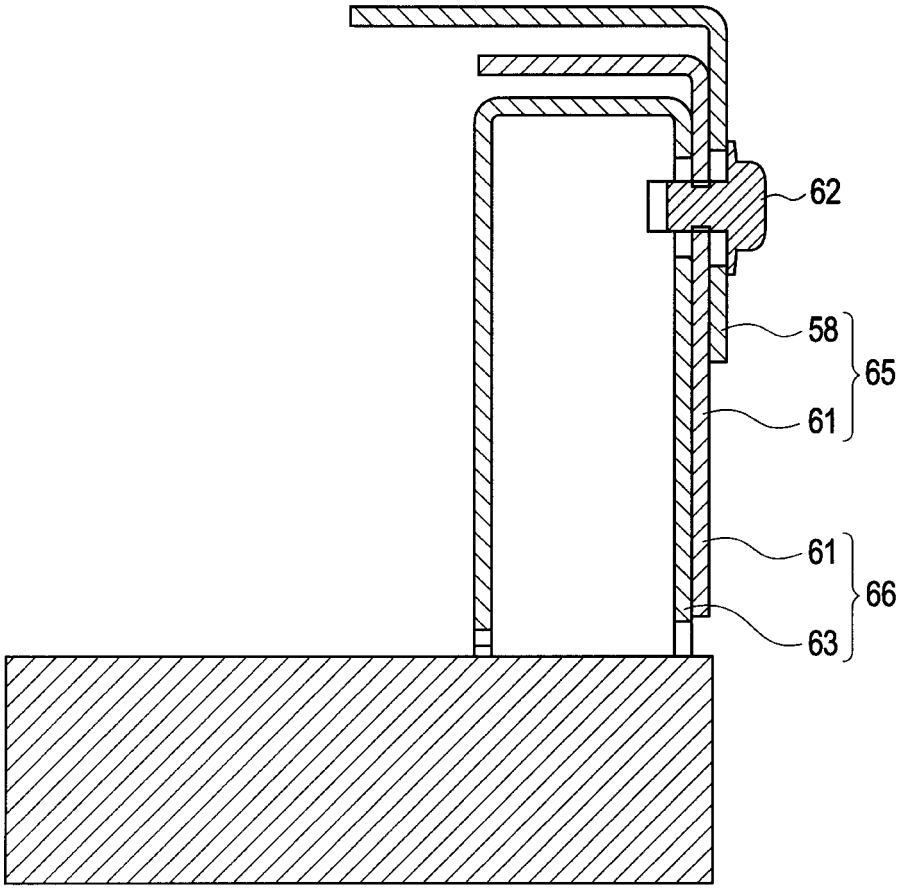
FIG. 8 is a cross-sectional view of the adjusting mechanism of the guide rail.

As shown in FIG. 5, the adjusting member 61 is temporarily fixed movably to the support base 63 with weak fastening force by the adjusting member fastening screws 64. At this time, as shown in FIG. 8, the guide rail 58 is already temporarily fixed movably to the adjusting member 61 with weak fastening force by the guide rail fastening screws 62.

Figure 6:
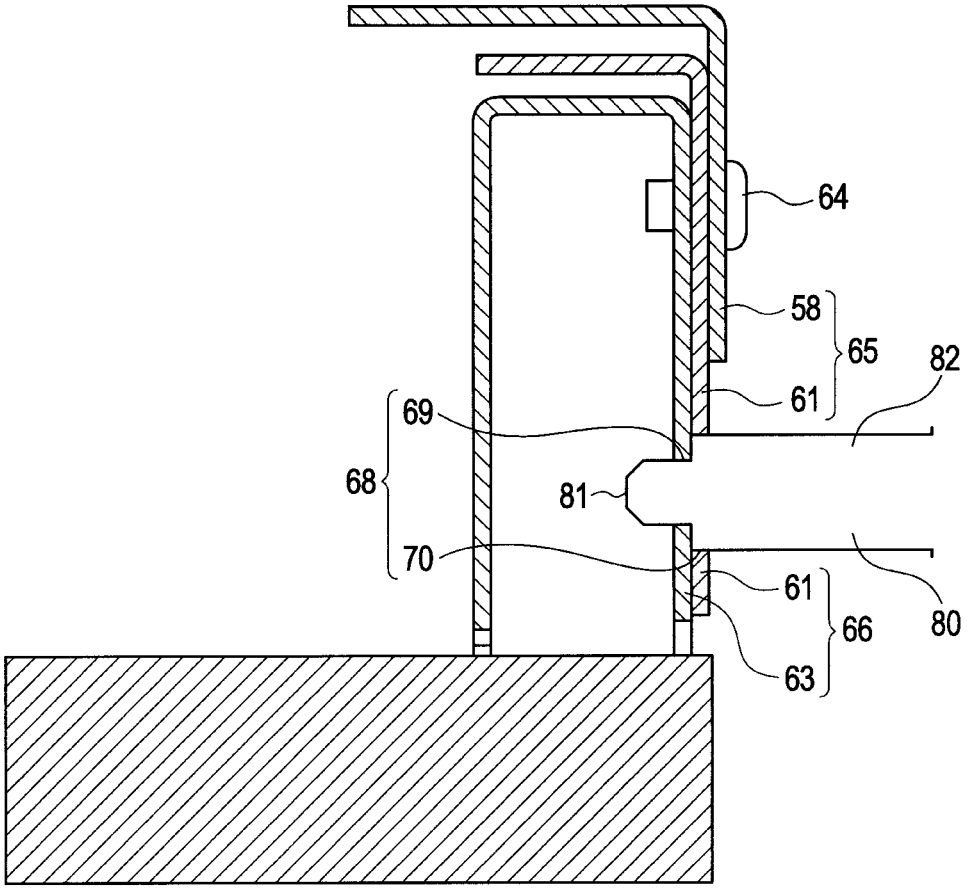
FIG. 6 is a cross-sectional view of the adjusting mechanism of the guide rail.
Figure 7:
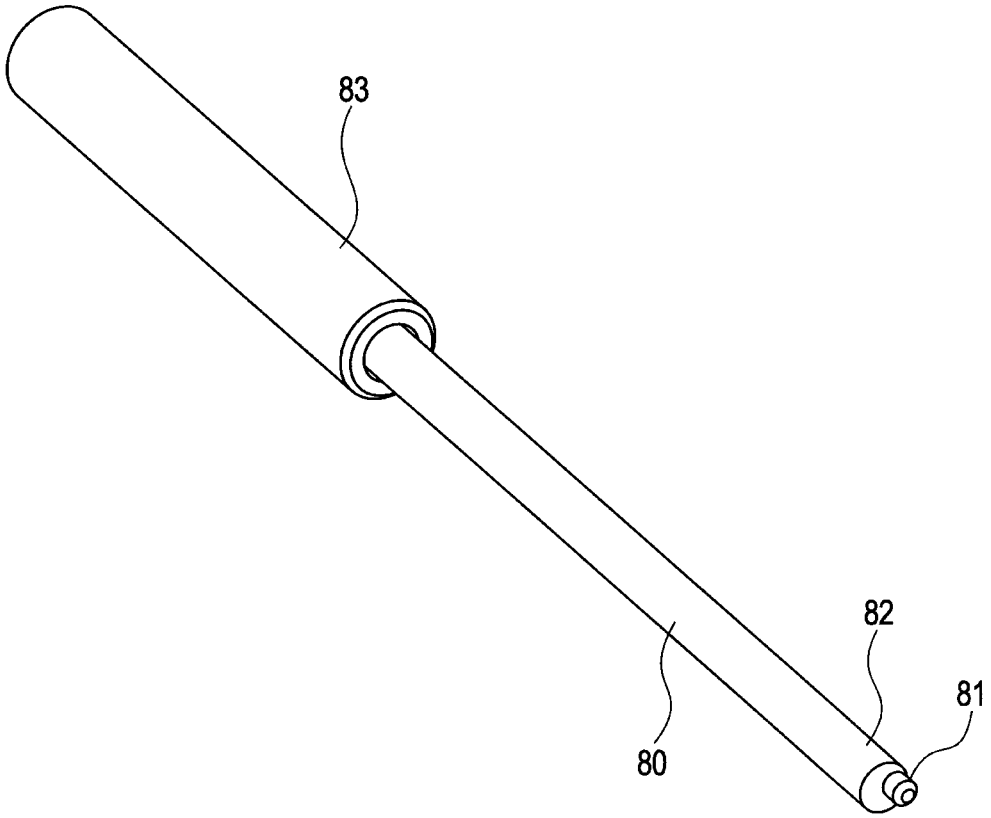
FIG. 7 is a diagram illustrating a tool for adjusting a position of the guide rail.

Next, as shown in FIG. 6, the position adjustment of the adjusting member 61 is performed by using a tool (for example, an eccentric cam) 80. As shown in FIG. 7, the tool 80 includes a shaft 81 that is formed on the front tip, a cam portion 82 and a handle 83. The shaft 81 projects out from a position away from the center of the cam portion 82. In the state that the shaft 81 of the tool 80 is inserted into the round hole 69 of the support base 63, the cam portion 82 is rotated using the handle so that the cam portion 82 presses the periphery of the upper side and the lower side of the elongated round hole 70 which is formed in the adjusting member 61. The position of the adjusting member 61 is adjusted in the up and down direction with respect to the support base 63 by the cam portion 82. The round hole 69 of the support base 63 and the elongated round hole 70 of the adjusting member 61 are the engaging section in which the tool 80 is engaged. After the positional adjustment of the adjusting member 61 is finished, the adjusting member fastening screws 64 are fastened and the adjusting member 61 is fixed to the support base 63 with a fastening force stronger than the temporary fixing.

Figure 9:
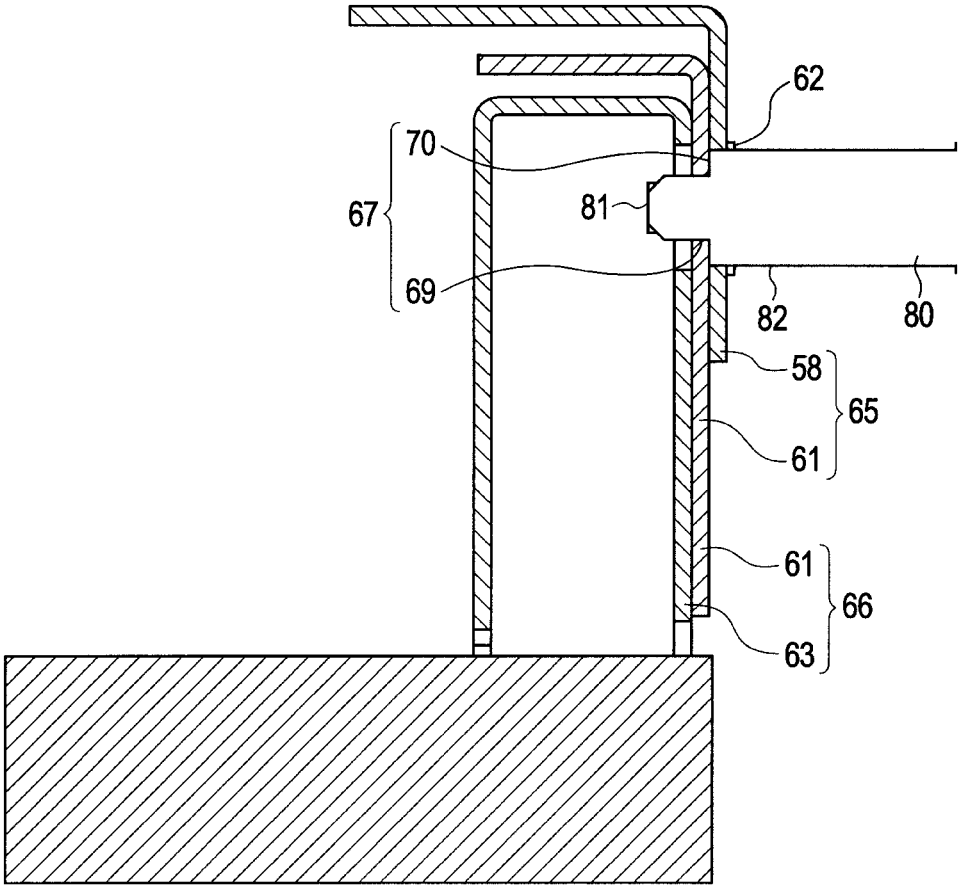
FIG. 9 is a cross-sectional view of the adjusting mechanism of the guide rail.

Next, as shown in FIG. 9, the tool 80 is rotated in the state that the shaft 81 is inserted into the round hole 69 that is formed on the adjusting member 61 so that the position of the guide rail 58 is adjusted. The cam portion 82 presses the periphery of the elongated round hole 70 that is formed in the guide rail 58 so that the position of the guide rail 58 is adjusted in the up and down direction. The round hole 69 of the adjusting member 61 and the elongated round hole 70 of the guide rail 58 are the engaging section in which the tool 80 is engaged. After the positional adjustment of the guide rail 58 is finished, the guide rail fastening screws 62 are fastened, and the guide rail 58 is fixed to the adjusting member 61 with a fastening force stronger than the temporary fixing.

Figure 4A:
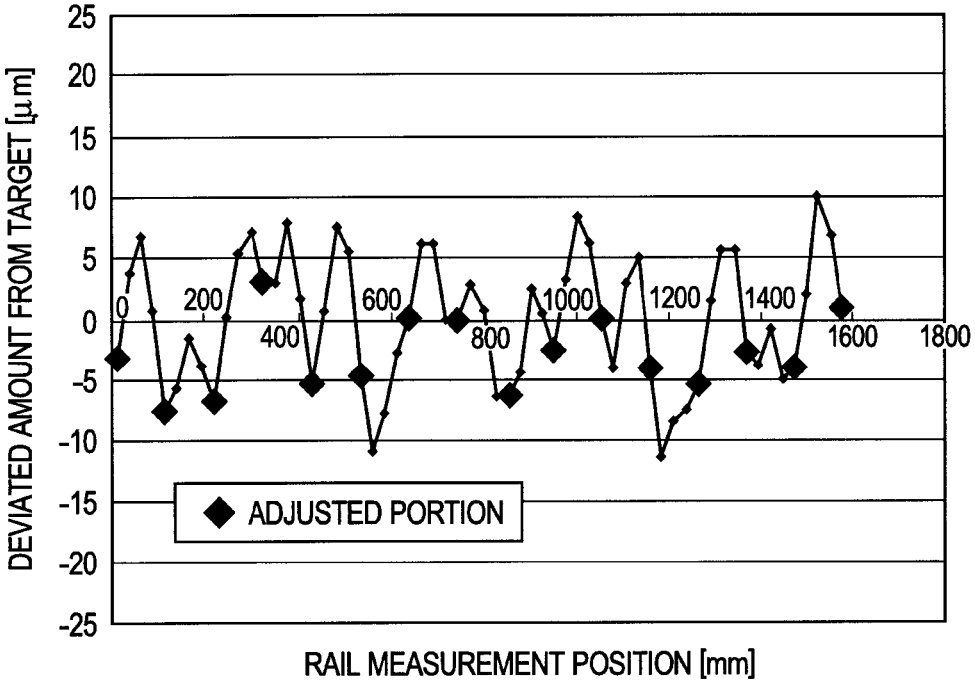
FIG. 4A is a profile of the planarity of the rail of the invention.
Figure 4B:
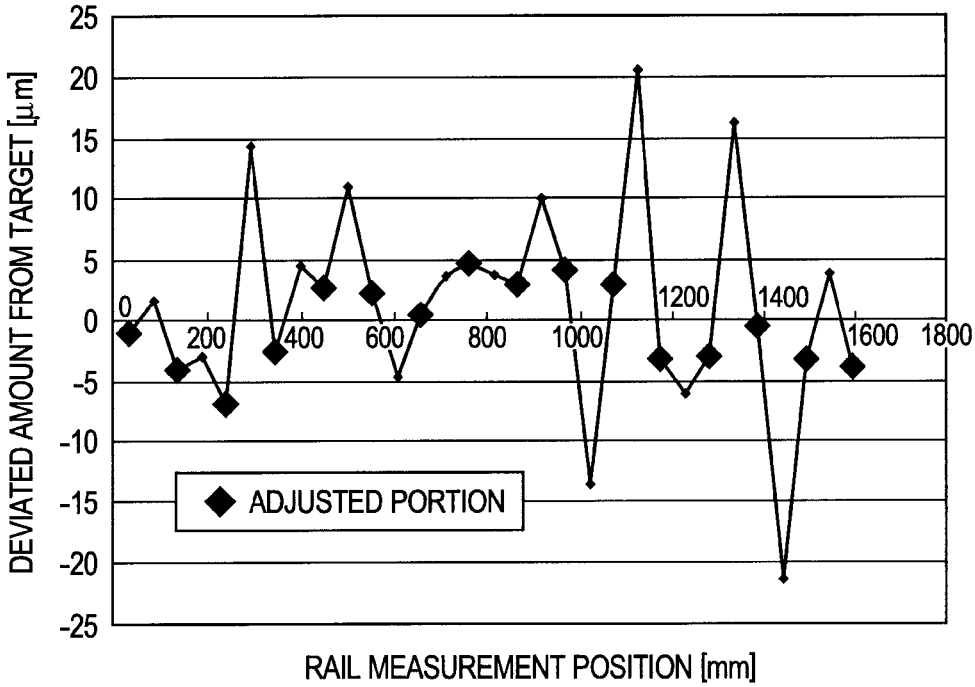
FIG. 4B is a profile of the planarity of the rail of the related art.

The adjustment method of Japanese Patent Application Laid-Open No. 2001-171194, specifically, after the guide rail 58 is adjusted by only the first adjusting mechanism 65, the profile all areas of the guide rail 58 in the X direction, and the profile of the guide rail 58 in which the adjustment is performed in two steps using the first and the second adjusting mechanism 65 and 66 of the invention are compared. The result of the comparison is shown in FIGS. 4A and 4B. FIG. 4A illustrates the profile (result of the adjustment) of the planarity of the rail according to the embodiment of the invention, and FIG. 4B illustrates the profile (result of the adjustment) of the planarity of the rail of the related art. The invention has a configuration such that the planarity of the middle portion between the adjusted portions can be largely enhanced and the planarity of all areas of the guide rail 58 can be decreased by half.

In the above description, the positions of the guide rail 58 and the adjusting member 61 are adjusted in the height direction (vertical direction), however the invention is not in practice limited to the adjustment in the height direction (vertical direction) according to the posture or layout when the recording apparatus is used. Generally, the adjustment is performed in the orthogonal direction to the main-scanning direction of the carriage.

As described above, while one embodiment of the invention has been described, the invention is not limited to the embodiment and a number of modifications can be made to the embodiment without departing from the gist of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-014176, filed Jan. 26, 2010, which is hereby incorporated by reference herein in its entirety.

What is claimed is:

1. A recording apparatus comprising:

a carriage configured to mount a recording head thereon and to reciprocate in a first direction;

a guide member extending in the first direction and configured to guide the carriage;

an adjusting member extending in the first direction and to which the guide member is fastened such that the adjusting member supports the guide member;

a support base extending in the first direction and to which the adjusting member is fastened such that the support base supports the adjusting member;

a plurality of first screws configured to fix the guide member to the adjusting member at a plurality of first fixing positions provided along the first direction, wherein each of the first screws fixes the guide member adjustably in a second direction perpendicular to the first direction relatively to the adjusting member without contacting the support base; and a plurality of second screws configured to fix the adjusting member to the support base at a plurality of second fixing positions provided along the first direction at positions different from the first fixing positions, wherein each of the second screws fixes the adjusting member adjustably in the second direction relatively to the support base without contacting the guide member.

2. The recording apparatus according to claim 1, further comprising a plurality of guide member adjusted portions provided along the first direction to displace the guide member in the second direction relatively to the adjusting member with a tool, and a plurality of adjusting member adjusted portions provided along the first direction to displace the adjusting member in the second direction relatively to the support base with the tool, wherein the guide member adjusted portions are provided in greater numbers than the adjusting member adjusted portions.

3. The recording apparatus according to claim 1, wherein a stiffness of the adjusting member is higher than that of the guide member and a stiffness of the support base is higher than that of the adjusting member.

4. The recording apparatus according to claim 1, wherein a fastening force of the first screws is larger than a fastening force of the second screws.

5. The recording apparatus according to claim 1, wherein more first fixing positions than second fixing positions are provided.

6. The recording apparatus according to claim 2, wherein the first fixing positions are adjacent to the guide member adjusted portions that displace the guide member in the second direction relatively to the adjusting member.

7. The recording apparatus according to claim 1, wherein the carriage reciprocates along a main guide rail extending in the first direction, and the guide member serves as a sub-guide rail.

* * * * *